US009038327B1

(12) United States Patent
Harkins

(10) Patent No.: US 9,038,327 B1
(45) Date of Patent: May 26, 2015

(54) SEAMLESS SHEET INSULATION AROUND ROOF STRUCTURAL MEMBERS

(71) Applicant: Daniel J. Harkins, Port Charlotte, FL (US)

(72) Inventor: Daniel J. Harkins, Port Charlotte, FL (US)

( * ) Notice: Subject to any disclaimer, the term of this patent is extended or adjusted under 35 U.S.C. 154(b) by 0 days.

(21) Appl. No.: 14/174,093

(22) Filed: Feb. 6, 2014

(51) Int. Cl.

| | |
|---|---|
| ***E04B 1/74*** | (2006.01) |
| ***E04D 5/14*** | (2006.01) |
| ***E04B 7/00*** | (2006.01) |
| ***E04B 1/76*** | (2006.01) |

(52) U.S. Cl.
CPC . *E04D 5/145* (2013.01); *E04B 7/00* (2013.01); *E04D 5/148* (2013.01); *E04B 1/7666* (2013.01); *E04B 1/76* (2013.01)

(58) Field of Classification Search
CPC ..... E04B 1/76; E04B 1/7604; E04B 1/7666; E04B 1/74
USPC ..... 52/404.1, 404.3, 407.3, 408, 410, 478, 52/483.1, 749.12
See application file for complete search history.

(56) References Cited

U.S. PATENT DOCUMENTS

| | | | | | |
|---|---|---|---|---|---|
| 4,361,993 | A * | 12/1982 | Simpson | 52/222 |
| 4,375,741 | A * | 3/1983 | Paliwoda | 52/127.1 |
| 4,528,790 | A * | 7/1985 | Lo et al. | 52/407.4 |
| 4,573,298 | A * | 3/1986 | Harkins | 52/404.3 |
| 5,581,966 | A * | 12/1996 | Fligg | 52/404.3 |
| 5,724,780 | A * | 3/1998 | Bolich | 52/407.4 |
| 5,901,518 | A * | 5/1999 | Harkins | 52/404.3 |
| 5,953,875 | A * | 9/1999 | Harkins | 52/407.3 |
| 6,235,365 | B1 * | 5/2001 | Schaughency et al. | 428/40.1 |
| 8,438,810 | B2 * | 5/2013 | Robbins et al. | 52/407.3 |
| 8,590,245 | B2 * | 11/2013 | Peng et al. | 52/407.4 |
| 8,621,805 | B2 * | 1/2014 | McClure | 52/404.1 |
| 2011/0107701 | A1 * | 5/2011 | Thomas | 52/408 |

* cited by examiner

*Primary Examiner* — Jeanette E Chapman
*Assistant Examiner* — James Buckle, Jr.
(74) *Attorney, Agent, or Firm* — Donald J. Ersler

(57) ABSTRACT

A seamless sheet installation system preferably includes a seamless sheet and a plurality of sheet retention devices. The seamless sheet is retained on a tube. A pair of rotating retention devices may be inserted into ends of the roll. Each rolling retention device includes a tube plug and a rotating handle. An end of the seamless sheet is secured to the top eave flange. The seamless sheet is held against a bottom of the eave purlin web with one of the plurality of sheet retention devices. The sheet retention device may have any suitable design. The seamless sheet is rolled out to successive purlins, wrapped over the top flange and anchored to a bottom of the vertical web with one of the plurality of sheet retention devices. The seamless sheet wrapping process is terminated at an opposing eave purlin or a ridge purlin. Insulation is then inserted between adjacent purlins.

24 Claims, 9 Drawing Sheets

SEAMLESS SHEET INSULATION AROUND ROOF STRUCTURAL MEMBERS

BACKGROUND OF THE INVENTION

1. Field of the Invention

The present invention relates generally to buildings and more specifically to a seamless sheet installation around roof structural members, which does not require the use of multiple lengthwise sheets to contain insulation between roof structural members and increases safety of the workmen installing and sealing sheet materials, roof insulation and roofing materials.

2. Discussion of the Prior Art

More stringent energy conservation codes are requiring much greater installed insulation thicknesses with greater installed insulation performances in building roofs and walls. These greater stringencies require different methods, which create space for greater thicknesses of insulation necessary to meet and exceed these higher thermal insulation requirements. Typically a sheet material is adhered or laminated to an insulation material such as fiberglass. This laminated insulation sheet material is installed between the exterior roof structural members and supported by steel straps which are installed substantially perpendicular, across the underside of the roof structural members such as metal building roof purlins. The side edges and end butt junctions of each of the individual laminated insulation sheet materials are then required to be sealed together over the tops of roof structural members. This sealing of the sheet materials is to resist air leakage due to pressure differences and convection currents to achieve optimal thermal performance of the insulation and to prevent condensation within the insulation.

Currently, installation of a sheet material for retaining insulation is primarily completed from the exterior of the building in conjunction with the roof sheeting process. Sealing of the building roof and walls insulation against air and moisture infiltration is a necessary requirement for meeting the minimum required building thermal performance. These thermal performance requirements are attempted to be accomplished with the strips of sheet material adhered to compressible strips of insulation, which are typically installed sequentially with the roof sheets of the building. The strip of sheet material is wider than the insulation strip. The sheet material is of sufficient extra width on each side of the insulation strip to form side edge tabs. The side edge tabs must accommodate a total thickness of the insulation material for the roof, plus the additional side edge tab sheet material of sufficient width to effectively seal one side edge tab to the next adjacent side edge tab lapped over the outermost surface of the roof structural members. The installation process positions the sheet material strip, with the adhered insulation strip with the two opposing sheet material side edge tabs, between two adjacent structural members with the side edge tabs installed up the sides of the roof structural members, lapped and sealed over the outermost surface of the roof structural members. This installation process is dangerous for a workman to perform, time consuming and expensive.

Failure to effectively seal the side edge tabs may result in air and water vapor leakage into the insulation cavity where it can spread throughout the roof insulation cavity where it may condense and result in accumulation of liquid water, the reduction of thermal performance and corrosion of roof structural members.

There is a similar need to effectively seal the multiple sheet materials together at abutted end joints. The current practice is simply hiding the abutted end joints from view above the building rafters. The multiple strips of sheet material are adhered to the strips of insulation and have side edge tabs that overlap for effective sealing, however the ends of these adhered sheet materials require the insulation materials to abut tightly together and effectively seal the abutted laminated insulation sheet material ends together. The operation must be done under foot, which is not practical to accomplish and typically the abutted ends are not sealed effectively, if at all.

Accordingly, there is a clearly felt need in the art for seamless sheet installation around roof structural members, which allows a single length of sheet material to be safely installed around a plurality of adjacent roof structural members to retain insulation between them and eliminate the danger and expense of sealing the multiple lengthwise sheet material side edge tabs together over the outer surfaces of every structural member of the roof. The single length of sheet material does not have insulation adhered to strips of sheet material and the abutted ends of the adjacent sheet material are easily and effectively lapped and sealed together above the building rafters beams. The single seamless sheet wrapped around a plurality of adjacent roof purlins and secured to building roof structural members provides safety to insulation and roof sheeting workmen for fall protection and protection from falling objects for workmen below.

SUMMARY OF THE INVENTION

The present invention provides a seamless sheet installation around roof structural members, which does not require the use multiple lengthwise sheets to contain insulation and eliminates dangerous elevated joint sealing over roof structural members and optionally provides fall protection safety and protection from falling objects to workmen. A metal building includes a floor, four walls, a plurality of columns, a plurality of rafters, a plurality of purlins or joists and a roof. A bottom of the plurality of columns are anchored to the floor on opposing sides of the metal building. The plurality of rafters are attached to a top of the plurality of columns. A plurality of roof structural members, such as purlins are attached to a top of the plurality of rafters. The purlins are attached directly to a top of a plurality of rafters or the purlins are attached to rafter clips, which extend upward from the top of the rafters.

The roof sheeting is attached to the top of the purlins to form the roof. The purlin includes a bottom flange, a vertical web and a top flange. The bottom flange extends in one direction from a bottom of the vertical web and the top flange extends in an opposite direction from a top of the vertical web. An eave purlin is attached to an end of the plurality of rafters. The eave purlin includes an eave bottom flange, an eave vertical web and an eave top flange. The eave bottom flange extends from a bottom of the eave vertical web and the eave top flange extends from a top of the eave vertical web in the same direction. Typically, a plurality of support straps are attached to the bottoms of the purlins perpendicular to the plurality of purlins in the roof area where the seamless sheet is to be installed. A seamless sheet and insulation strips are supported by the plurality of support straps.

Seamless sheet installation around roof structural members (seamless sheet installation system) preferably includes a seamless sheet and a plurality of sheet retention devices. The seamless sheet is retained on a sheet tube for installation. A pair of rotating retention devices may be inserted with one such device into each end of the sheet tube. Each rotating retention device includes a tube plug and a rotating handle. The tube plug is sized to be firmly retained in the sheet tube. The rotating handle is rotatably retained relative to the tube plug. A single workman grasps a handle of one of the two rotating retention devices at each end of the tube for laying out the sheet material, one purlin space at a time.

An end of the seamless sheet is secured to the eave purlin with any suitable means, such as fasteners, adhesive or double sided tape of sufficient overall strength to withstand forces of fall protection safety tests. The seamless sheet is held in a junction between the eave purlin bottom flange and the eave purlin vertical web with one of the plurality of sheet retention devices. The sheet retention device may have any suitable design. The sheet retention device could be a rod with any suitable cross sectional shape having a length that extends substantially between two adjacent rafters. A portion of the rod could also be magnetized to hold the seamless sheet firmly against the steel purlin web, adjacent a purlin bottom flange. The seamless sheet is rolled out to the bottom flange of a first purlin. The seamless sheet is anchored inside a junction of the bottom flange and a bottom of the vertical web of each purlin with one of the sheet retention devices. The seamless sheet is wrapped over the top flange of the next adjacent purlin and anchored against the bottom of the vertical web with another one of the sheet retention devices. The seamless sheet wrapping process is repeated over a plurality of purlins and is terminated at an eave purlin on the opposite side of the building, a ridge purlin, or at any purlin of a plurality of purlins. The opposing end of the seamless sheet is secured to the eave purlin, the ridge purlin, or any purlin of a plurality of purlins with any suitable means, such as fasteners, adhesives or double sided tape. Additional retention clips that retain the sheet material configured tightly around the upper flange of each purlin may also be used to insure the correct length of sheet material is laid out between purlins to minimize any gap which may occur under the top flange of the purlin to the purlin vertical web. Insulation is then inserted between each pair of adjacent purlins and the roof sheeting is applied over the tops of the purlins.

The seamless sheet is securely attached at two opposing ends with excess length proportionately distributed between adjacent pairs of the plurality of purlins and retained in such a manner that the seamless sheet reliably absorbs impact forces of fall protection safety tests.

A release backing tape preferably includes a first adhesive cover, an adhesive member, a second adhesive cover and a pull cord. The first and second adhesive covers are attached to opposing sides of the adhesive member to prevent the adhesive member from prematurely sticking to some object. An end of the pull cord is secured to an end of the second adhesive cover. A length of the pull cord is light tacked to the length of the second adhesive cover. The first adhesive cover is removed from a first side of the adhesive member and the adhesive member is attached to a purlin. The seamless sheet is laid over the purlin and insulation is laid between two adjacent purlins. The second adhesive cover is removed by pulling the pull cord at an opposing end of the seamless sheet. The seamless sheet is attached to the purlin by the force applied by an edge of the insulation.

A second embodiment of the seamless sheet preferably includes a first sheet layer, a plurality of transverse retention strips and a second sheet layer. The plurality of transverse retention strips are retained between the first and second sheet layers, across a width of the seamless sheet. Plurality of strips are fabricated from any suitable material. The second embodiment of the seamless sheet may be secured to a purlin with a plurality of fasteners, tape, clips or any other suitable device to retain the seamless sheet in position to receive the insulation strips.

Accordingly, it is an object of the present invention to provide a seamless sheet installation system, which allows a single length of sheet material to be safely installed around roof structural members to retain insulation, instead of seaming multiple side edge tabs of lengthwise sheets of material together over roof structural members such as purlins.

It is further an object of the present invention to provide a seamless sheet installation method, which increases installation safety by eliminating sealing edge tab laps over the tops of purlins of the building roof system beyond a safe arms length distance from the adjacent building rafters.

It is yet a further an object of the present invention to provide a system, which can be used by workmen for fall prevention, fall protection and for prevention from falling objects.

It is a final object of the present invention to provide fall protection safety for workmen erecting insulation and roofing materials, which is compliant with OSHA fall protection requirements by eliminating field splicing required of insulation adhered to strips of sheet materials.

These and additional objects, advantages, features and benefits of the present invention will become apparent from the following specification.

DETAILED DESCRIPTION OF THE PREFERRED EMBODIMENTS

Figure 1:
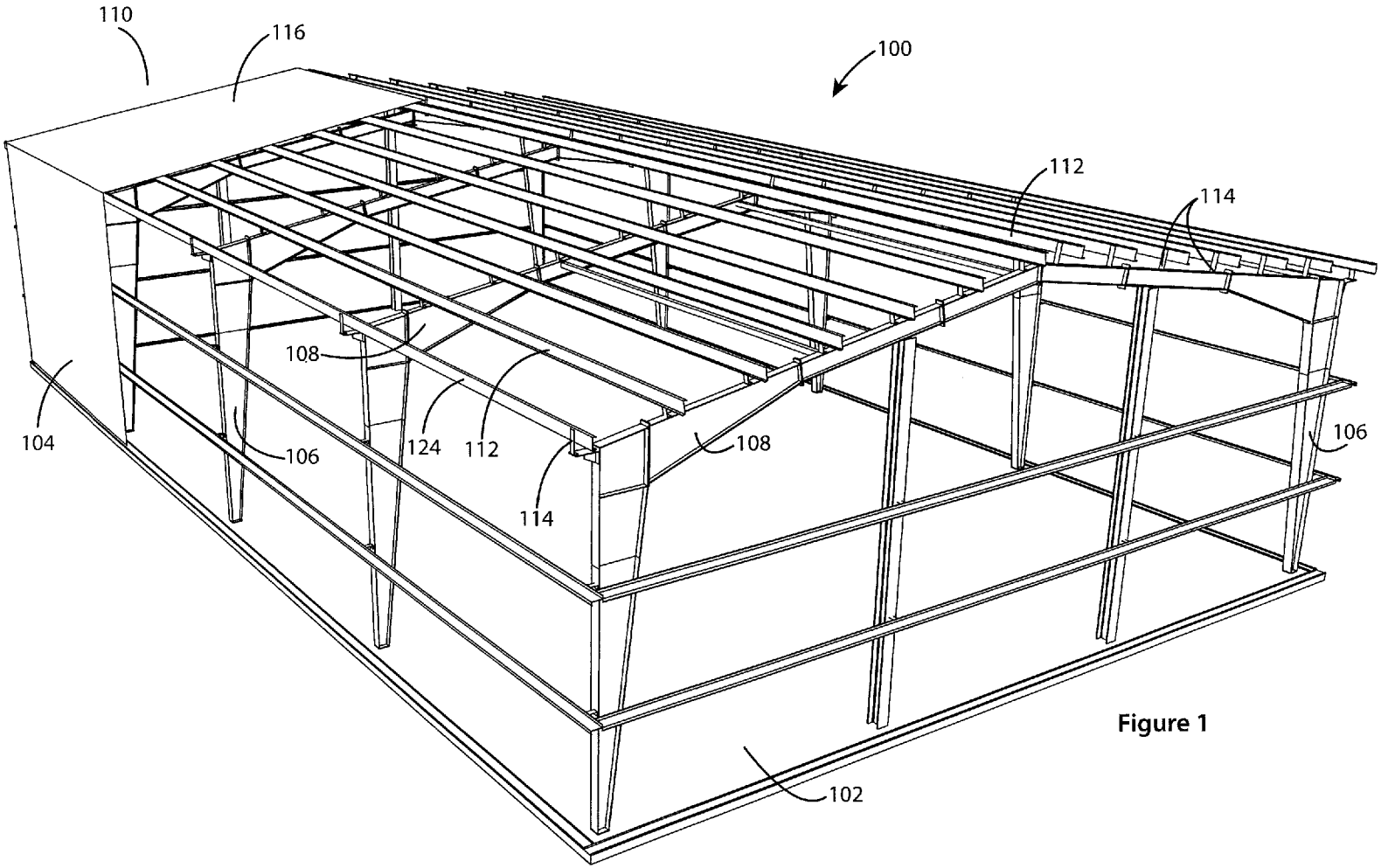
FIG. 1 is a perspective view of a metal building.

With reference now to the drawings, and particularly to FIG. 1, there is shown a perspective view of a metal building 100. The metal building 100 includes a floor 102, four walls 104, a plurality of columns 106, a plurality of rafters 108 and a roof 110. A bottom of the plurality of columns 106 are anchored to the floor 102 on opposing sides of the metal building 100. The plurality of rafters 108 are attached to a top of the plurality of columns 106. A plurality of roof structural members, such as purlins 112 are attached to a top of the plurality of rafters 108. The purlins 112 are attached directly to a top of a plurality of rafters 108 or the purlins are attached to rafter clips 114, which extend upward from the top of the rafters 108. Roof sheeting 116 is attached to the top of the purlins 112.

Figure 2:
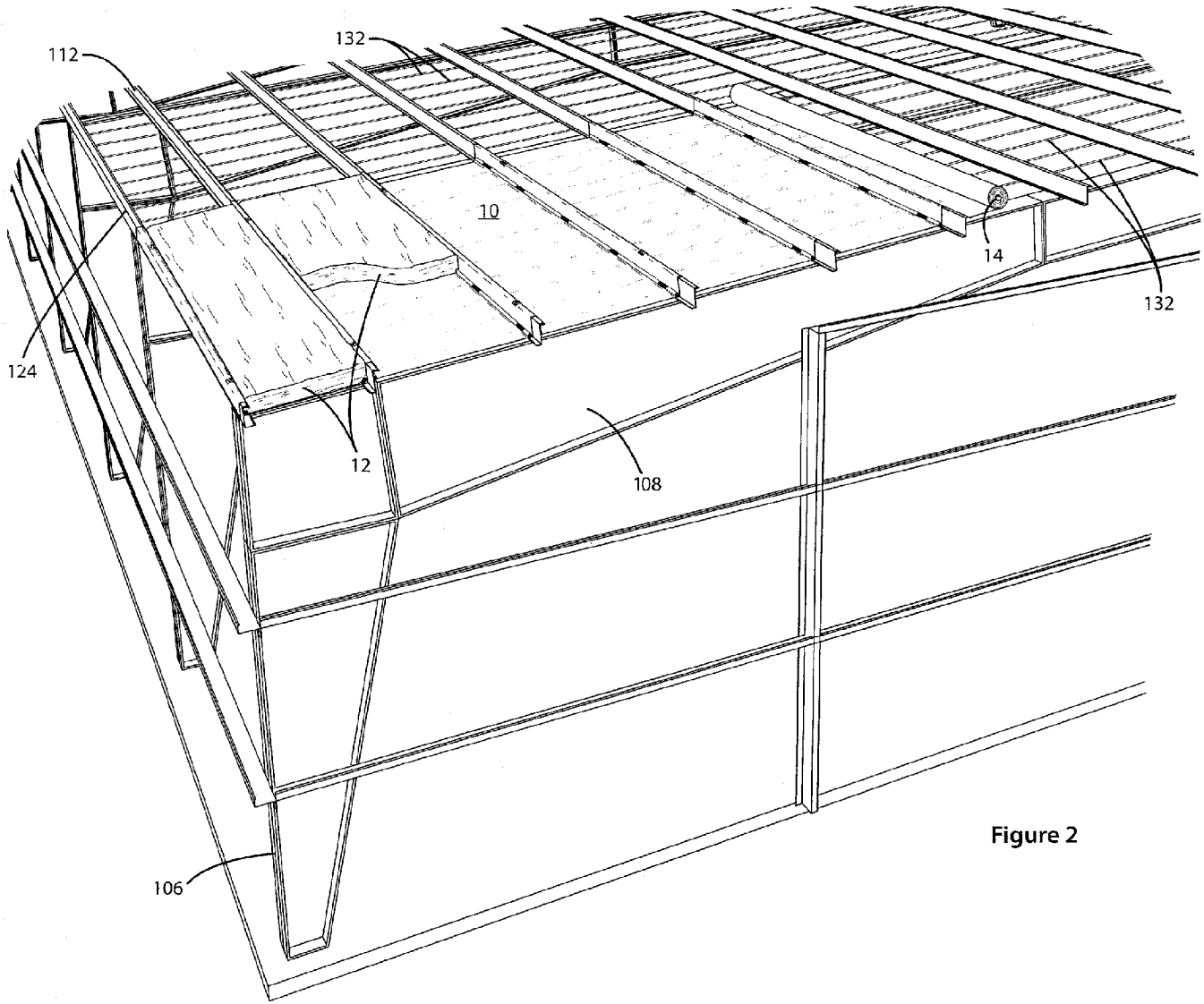
FIG. 2 is a perspective view of a metal building with a seamless sheet insulation system partially installed thereupon in accordance with the present invention.
Figure 3:
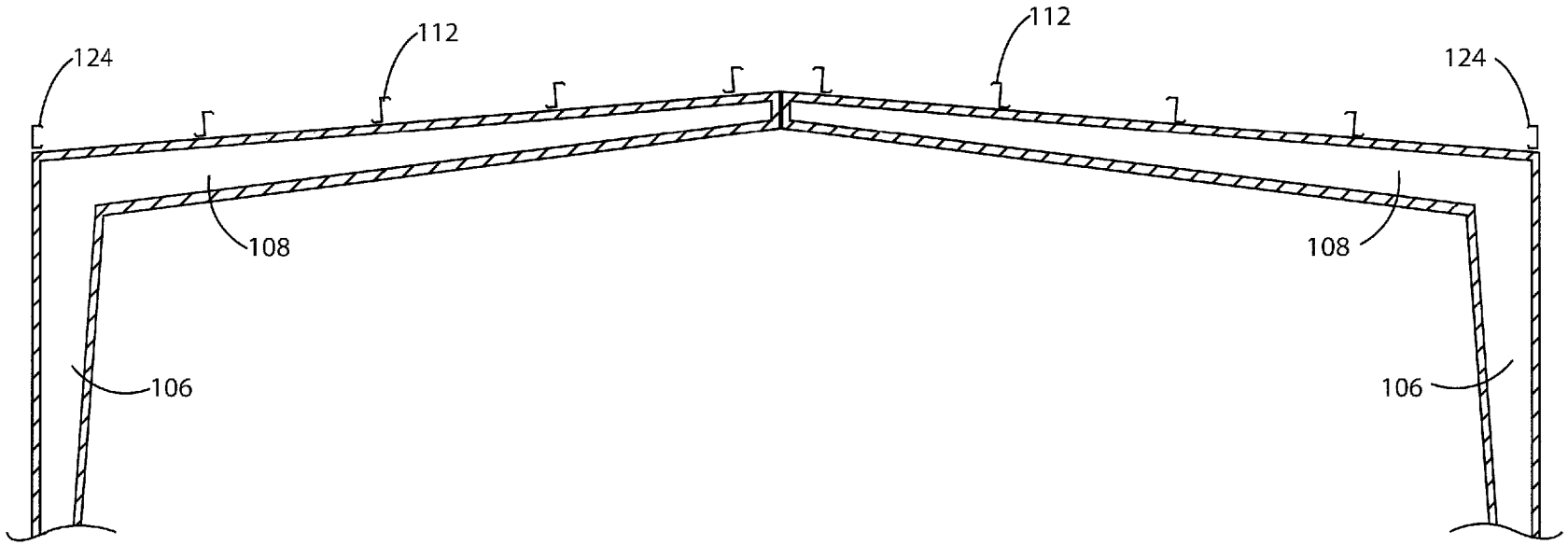
FIG. 3 is an end view of a pair of rafters of a metal building with a plurality of purlins attached to the pair of rafters of a seamless sheet insulation system in accordance with the present invention.
Figure 4:
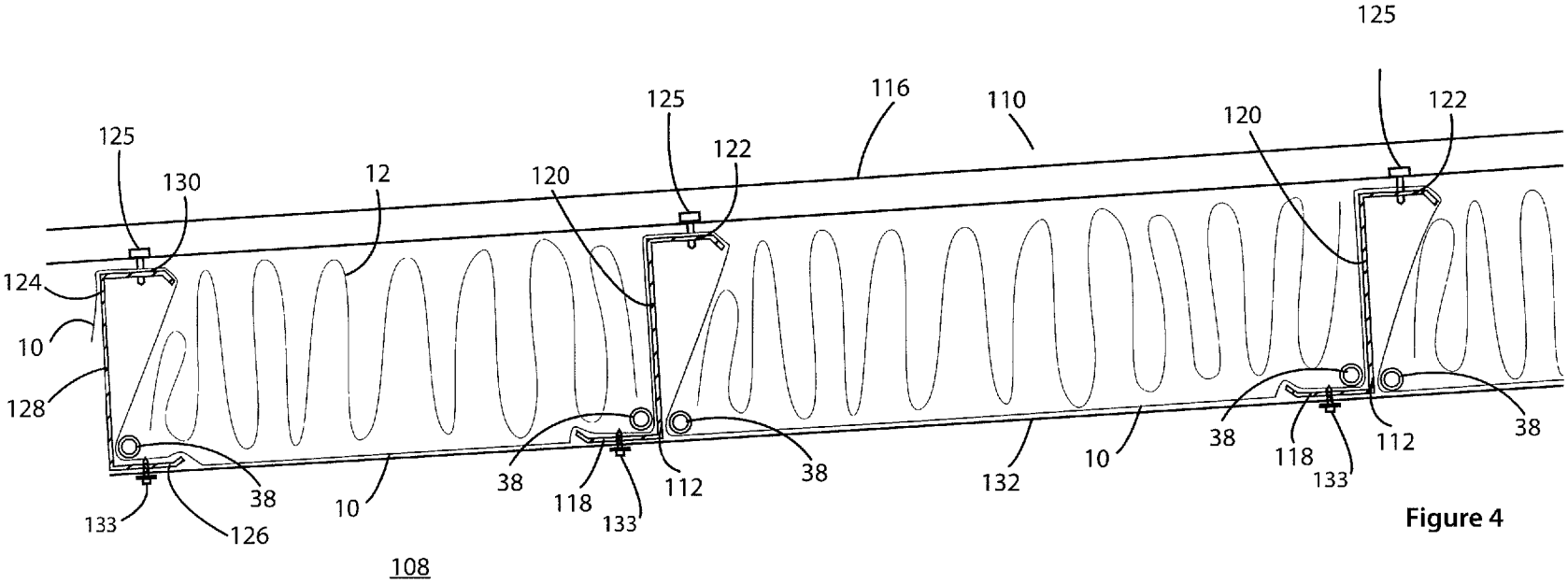
FIG. 4 is an enlarged end view of a portion of a rafter and purlins of a metal building with a seamless sheet insulation system installed therein in accordance with the present invention.
Figure 6:
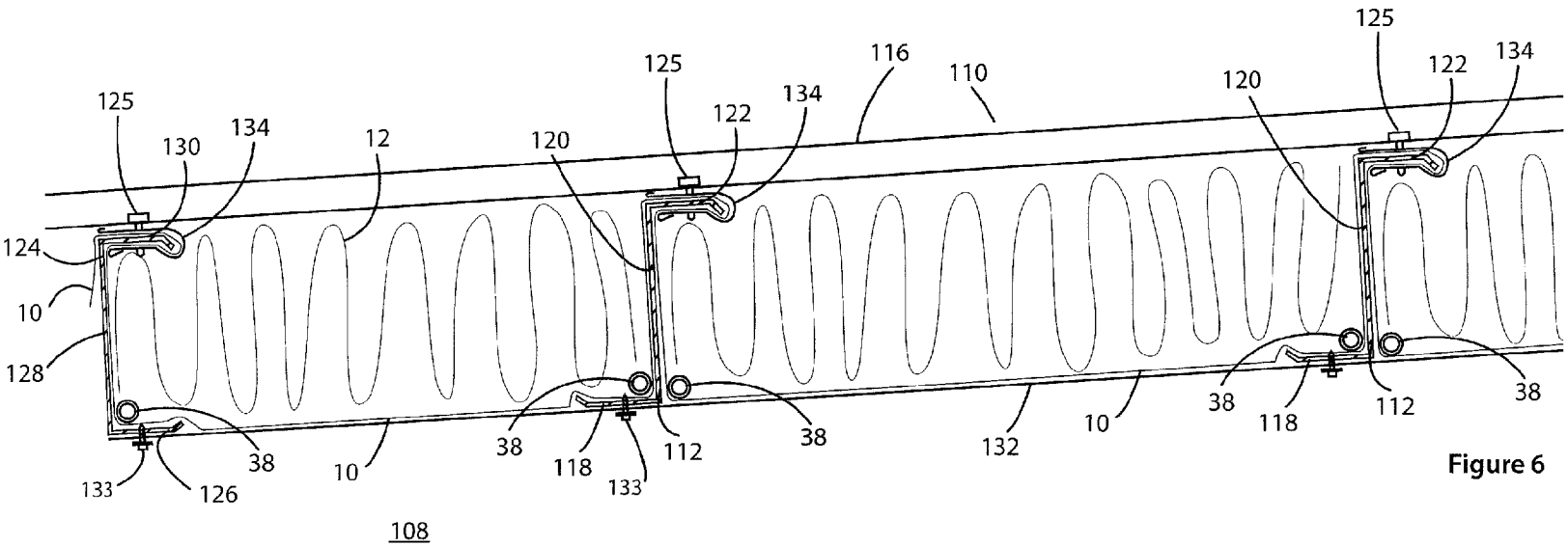
FIG. 6 is an enlarged end view of a portion of a rafter of a metal building with a seamless sheet insulation system installed therein and utilizing retention clips in accordance with the present invention.

With reference to FIGS. 3-4, the roof sheeting 116 is attached to the top of the purlins 112 to form the roof 110. The purlin 112 includes a bottom flange 118, a vertical web 120 and a top flange 122. The bottom flange 118 extends in one direction from a bottom of the vertical web 120 and the top flange 122 extends in an opposite direction from a top of the vertical web 120. An eave purlin 124 is attached to an end of the plurality of rafters 108. The eave purlin 124 includes an eave bottom flange 126, an eave vertical web 128 and an eave top flange 130. The eave bottom flange 126 extends from a bottom of the eave vertical web 128 and the eave top flange 130 extends from a top of the eave vertical web 128 in the same direction. With reference to FIGS. 2,4,6 a plurality of support straps 132 are attached perpendicular to a bottom of the plurality of purlins 112, 124 with a plurality of fasteners 133. A seamless sheet 10 and insulation strip 12 are supported by the plurality of support straps 132.

Figure 7:
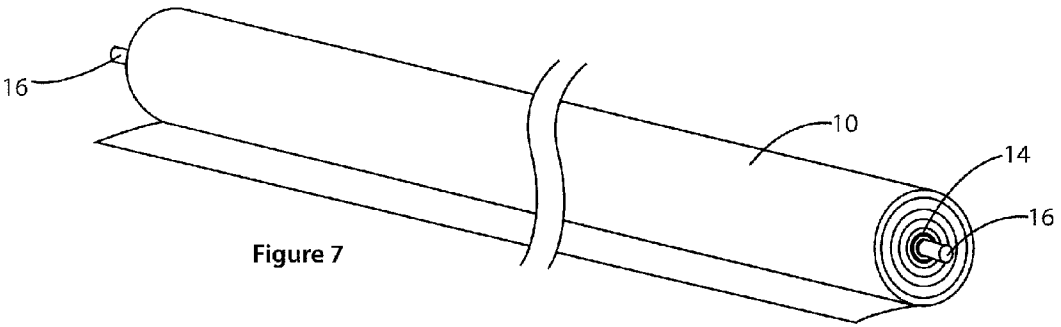
FIG. 7 is a perspective view of a seamless sheet tube with a rotating handle inserted into one end thereof of a seamless sheet insulation system in accordance with the present invention.
Figure 8:
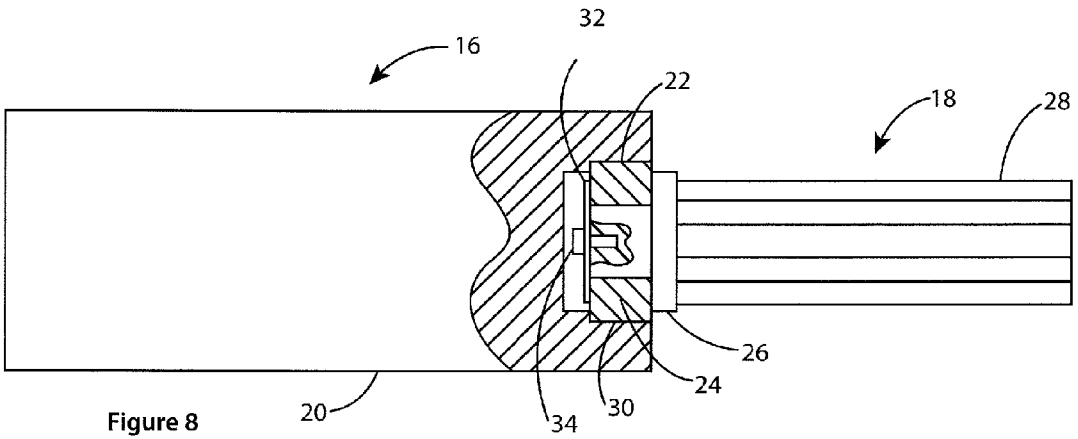
FIG. 8 is a side view of a rotating handle of a seamless sheet installation system in accordance with the present invention.
Figure 9:
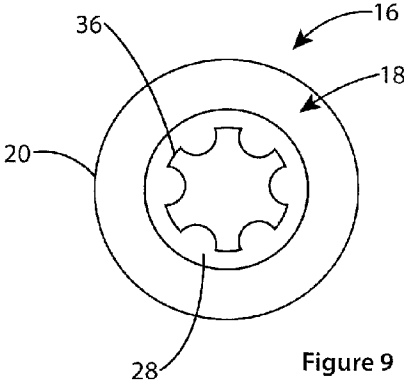
FIG. 9 is an end view of a rotating handle of a seamless sheet installation system in accordance with the present invention.

With reference to FIGS. 4 and 6, seamless sheet installation around roof structural members (seamless sheet installation system) preferably includes the seamless sheet 10 and a plurality of sheet retention devices 38. The seamless sheet 10 is retained on a sheet tube 14. With reference to FIGS. 7-9, a pair of rotating retention devices 16 may be inserted into each end of the sheet tube 14. Each rolling retention device 16 preferably includes a tube plug 18, a rotating handle 20 and bearing 22. The tube plug 18 preferably includes a bearing portion 24, a shoulder 26 and a tube plug portion 28. The bearing portion 24 extends from one end of the shoulder 26 and the tube plug portion 28 extends from an opposite end of the shoulder 26.

The bearing 22 is pressed into a bearing bore 30 formed in an end of the handle 20. A retention washer 32 is preferably secured to an end of the bearing portion 24 with a fastener 34. A plurality of lengthwise projections 36 form an outer perimeter of the tube plug portion 28. The plurality of lengthwise projections 36 contact an inner perimeter of the sheet roll tube 14. The plurality of lengthwise projections 36 are sized to be firmly retained in the inner perimeter of the sheet roll tube 14. A single workman grasps the handle 20 on one of the rotating retention devices 16.

Figure 10:
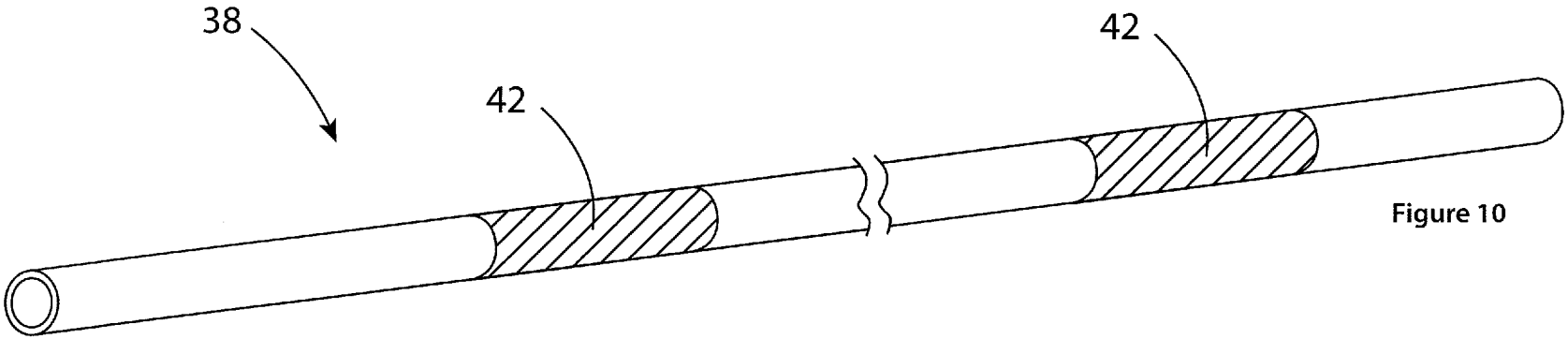
FIG. 10 is a perspective view of a magnetized sheet retention device of a seamless sheet installation system in accordance with the present invention.
Figure 11:
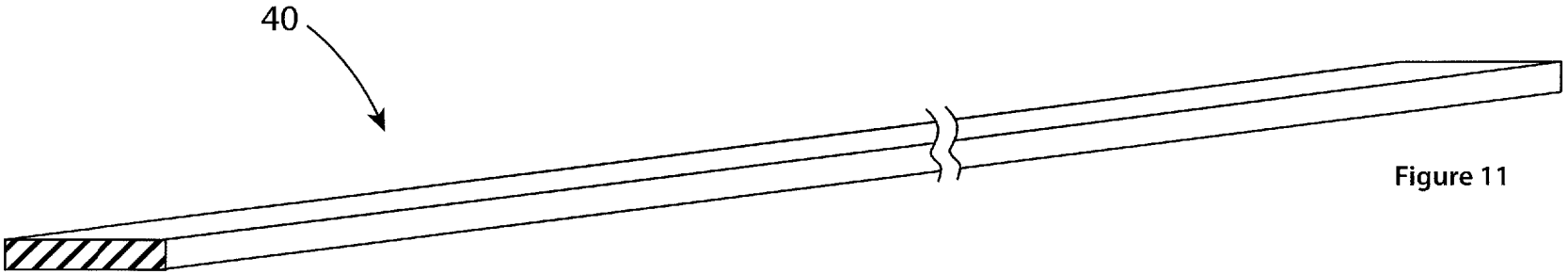
FIG. 11 is a perspective view of a non-magnetized sheet retention device of a seamless sheet installation system in accordance with the present invention.

With reference to FIG. 4, an end of the seamless sheet 10 is secured to the top eave purlin flange 130, eave purlin vertical web 128 or eave purlin bottom flange 126 with any suitable means, such as mechanical fasteners 125, adhesives, or double sided tape. The seamless sheet 10 is secured to the purlins 112, 124 to withstand forces of fall protection safety tests. The impact test includes dropping a 400 lb. load from a height of 42 inches to comply with OSHA fall protection safety regulations. With reference to FIGS. 10-11, the seamless sheet 10 is held in a junction between the eave purlin bottom flange 126 and the eave vertical web 128 with one of the plurality of sheet retention devices 38, 40. However, the sheet retention device may have any other suitable design such as shown in traverse strips 156 of a seamless sheet 152 secured to purlins 112, 124 with fasteners 160 in FIGS. 14-16. The sheet retention device 38 preferably includes a plurality of magnetic sections 42 spaced along a length thereof. The sheet retention device 38 preferably has a round shape and a length that extends substantially between two adjacent rafters 108. The plurality of magnetic sections 42 retain the seamless sheet 10 firmly against the purlins 112, 124.

The sheet retention device 40 preferably has a rectangular cross section and a length that extends substantially between two adjacent rafters 108.

The seamless sheet 10 is rolled out to the bottom flange 118 of a first purlin 112. The seamless sheet 10 is anchored inside a junction of the bottom flange 118 and a bottom of the vertical web 120 with one of the sheet retention devices 38. The seamless sheet 10 is wrapped over the top flange 122 of the first purlin 112 and anchored against the bottom of the vertical web 120 with one of the sheet retention devices 38. The seamless sheet purlin wrapping process is repeated for successive purlins 112 and is terminated at the eave purlin 124 on the opposite side of the building 100, at a ridge purlin or at any other of a plurality of roof purlins. The end of the seamless sheet 10 is secured to the top eave flange 130, eave purlin vertical web 128 or eave purlin bottom flange 126 with any suitable means, such as mechanical fasteners 125, adhesives or double sided tape. The insulation is then inserted between adjacent purlins 112, 124. The seamless sheet 10 may also be secured to the top flanges of the purlins 112 with a fastener 125. The sheet retention devices 38, 40 may be left in place after the insulation 12 and roof sheet 116 are installed, may be shifted over axially to retain the seamless sheet between another pair of adjacent rafters 108 as the seamless sheet 10 is installed as described above or the retention devices 38,40 may be simply removed for future use in another seamless sheet 10 installation.

Figure 5:
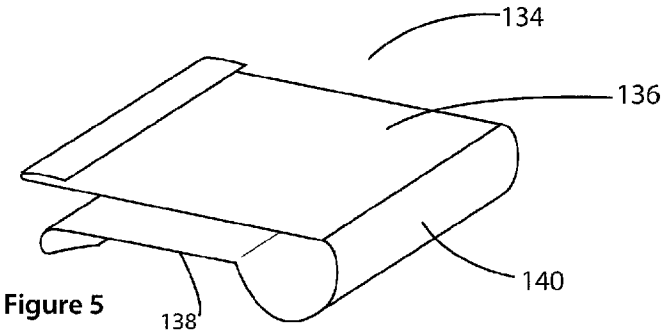
FIG. 5 is a perspective view of a retention clip for retaining a seamless sheet of a seamless sheet insulation system in accordance with the present invention.

With reference to FIGS. 5-6, a retention clip 134 includes a first leg 136, a second leg 138 and a spring junction 140. The spring junction 140 causes an end of the first leg 136 to be biased against an end of the second leg 138. The retention clip 134 is preferably fabricated from a single piece of material, such as spring steel. A plurality of retention clips 134 are used to secure the seamless sheet 10 to a bottom of the top flanges 122 and 130. The plurality of retention clips 134 may be removed, after insertion of the insulation strip 12. However, the plurality of retention clips 134 may be secured to the top flanges 122, 130 with a plurality of fasteners 125.

Figure 12:
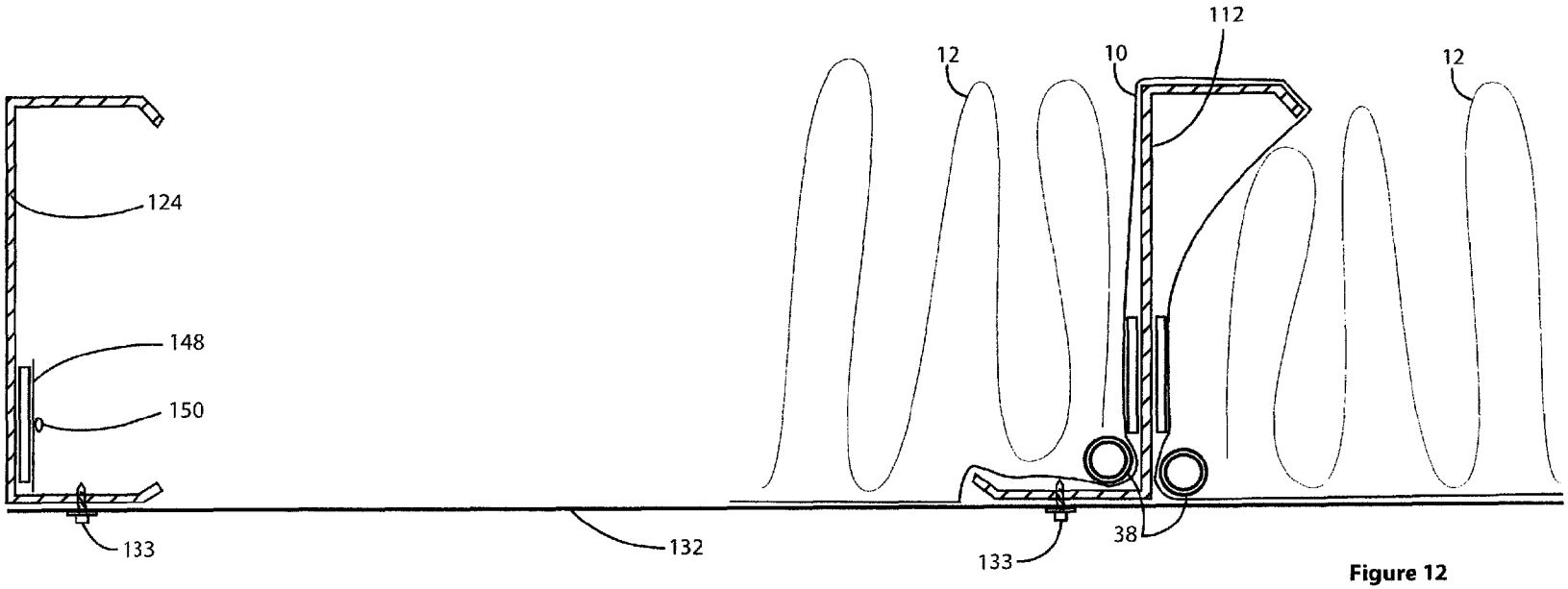
FIG. 12 is an end view of a release backing tape applied to purlins to retain a seamless sheet of a seamless sheet installation system in accordance with the present invention.
Figure 13:
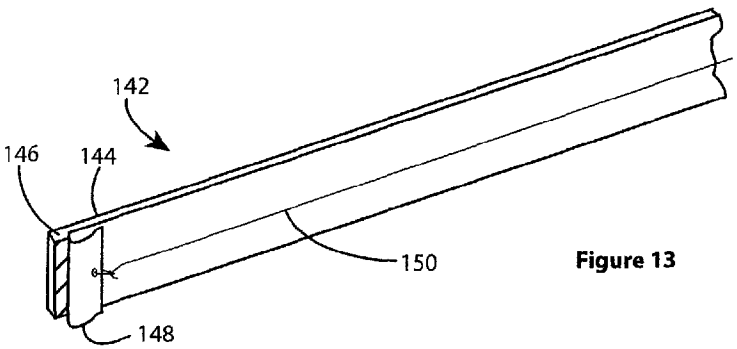
FIG. 13 is a perspective view of a release backing tape with an adhesive cover partially removed by pulling a pull cord of a seamless sheet installation system in accordance with the present invention.

With reference to FIGS. 12-13, a release backing tape 142 preferably includes a first adhesive cover 144, an adhesive member 146, a second adhesive cover 148 and a pull cord 150. The first and second adhesive covers 144, 146 are attached to opposing sides of the adhesive member 146 to prevent the adhesive member 146 from prematurely sticking to some object. An end of the pull cord 150 is secured to an end of the second adhesive cover 148 with any suitable method. A length of the pull cord 150 is light tacked to the length of the second adhesive cover 148. The first adhesive cover 144 is removed from a first side of the adhesive member 144 and the adhesive member 144 is attached to the purlin 112, 124. The seamless sheet 10 is laid over the purlins 112, 124. The sheet retention devices 38 and 134 may be used to retain the seamless sheet 10 in place, before the insulation 12 is installed between adjacent purlins 112, 124. The second adhesive cover 148 is removed by pulling the pull cord 150 at an opposing end of the seamless sheet 10 adjacent the building rafter 108. The seamless sheet 10 is attached to the vertical webs 120, 128 of the purlin 112,124 by the force applied by an edge of the insulation 12 against the seamless sheet 10 and in turn to the exposed adhesive member 146. The fully applied release backing tape 142 prevents moisture from passing upward past the adhesive member 146 of applied release backing tape 142.

Figure 14:
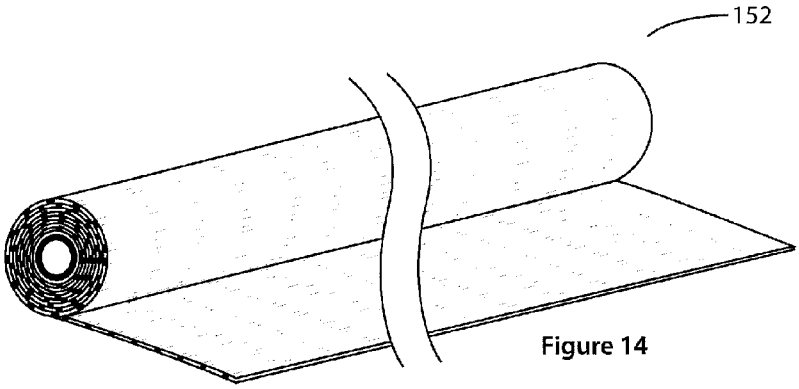
FIG. 14 is a perspective view of a seamless sheet roll with embedded strips of a seamless sheet installation system in accordance with the present invention.
Figure 15:
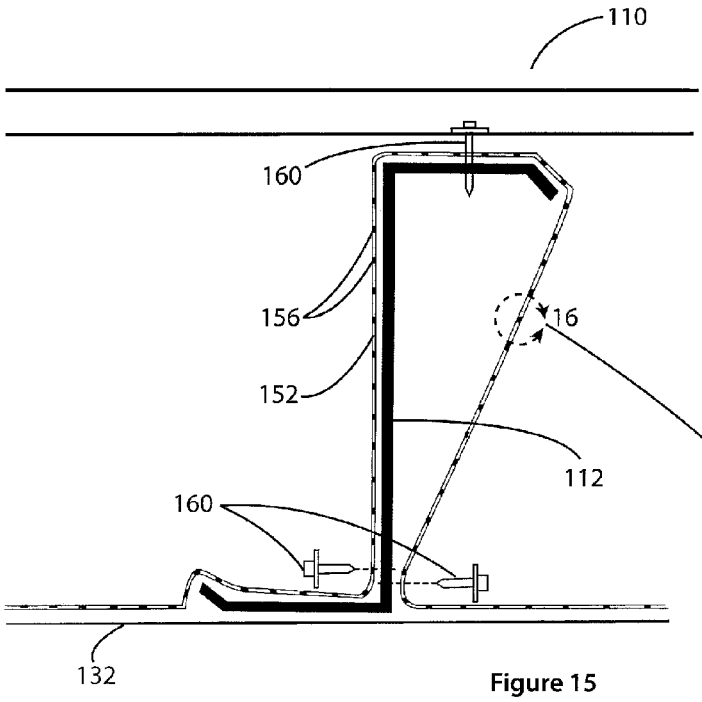
FIG. 15 is an end view of a seamless sheet roll with a plurality of embedded strips attached to a purlin with a plurality of fasteners of a seamless sheet installation system in accordance with the present invention.
Figure 16:
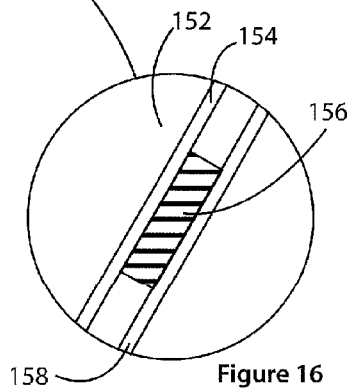
FIG. 16 is an enlarged end view of a seamless sheet roll with a plurality of embedded strips of a seamless sheet installation system in accordance with the present invention.

With reference to FIGS. 14-16, a second embodiment of the seamless sheet 152 preferably includes a first sheet layer 154, a plurality of transverse strips 156 and a second sheet layer 158. The plurality of transverse strips 156 are retained between the first and second sheet layers 154, 158, across a width of the seamless sheet 152. The plurality of strips 156 are fabricated from any suitable material. The seamless sheet 152 may be secured to the purlin 112 with a plurality of fasteners 160, tape, clips or any other suitable device.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of installing a seamless sheet on a plurality of purlins of a building comprising the steps of:

attaching a plurality of support straps spanning between adjacent purlins of the plurality of purlins, said plurality of support straps are located below a bottom of the plurality of purlins;

providing a plurality of sheet retention devices;

securing an end of said seamless sheet to a first purlin of the plurality of purlins;

wrapping said seamless sheet over a top of a second purlin of the plurality of purlins with excess seamless sheet material between the two adjacent purlins of the plurality of purlins to be in contact with the support straps, anchoring said seamless sheet adjacent to a side of the first purlin with one of said plurality of sheet retention devices, anchoring said seamless sheet adjacent to a side of the second purlin with a second one of said plurality of sheet retention devices; and retaining said seamless sheet in contact with the plurality of straps between successive purlins of the plurality of purlins, said seamless sheet is retained against the sides of successive purlins of the plurality of purlins with said plurality of sheet retention devices.

2. The method of installing a seamless sheet on a plurality of purlins of a building of claim 1, further comprising the step of:

inserting insulation between adjacent purlins of the plurality of purlins.

3. The method of installing a seamless sheet on a plurality of purlins of a building of claim 2, further comprising the step of:

shifting said plurality of sheet retention devices between another pair of adjacent rafters after the insulation is installed.

4. The method of installing a seamless sheet on a plurality of purlins of claim 1, further comprising the step of:

removing said plurality of sheet retention devices after installing insulation between said plurality of purlins.

5. The method of installing a seamless sheet on a plurality of purlins of a building of claim 1, further comprising the step of:

providing at least one of said plurality of sheet retention devices with at least one magnetic section.

6. The method of installing a seamless sheet on a plurality of purlins of a building of claim 1, further comprising the step of:

retaining said seamless sheet rolled on a tube, inserting a rotating retention device in each end of the tube.

7. The method of installing a seamless sheet on a plurality of purlins of a building of claim 6, further comprising the step of:

providing said rotating retention device with a tube plug and a rotating handle, said rotating handle is rotatably retained relative to said tube plug.

8. The method of installing a seamless sheet on a plurality of purlins of a building of claim 1, further comprising the step of:

providing said seamless sheet with the strength to withstand dropping a 400 lb. weight from a height of 42 inches.

9. The method of installing a seamless sheet on a plurality of purlins of a building of claim 1, further comprising the step of:

providing a retention clip for retaining said seamless sheet on at least one of the plurality of purlins.

10. A seamless sheet for attachment to a plurality of purlins of a building comprising:

a plurality of straps are attached to bottoms of the plurality of purlins, each purlin includes a vertical portion;

said seamless sheet is attached to a portion of the plurality of purlins, said seamless sheet is wrapped over the plurality purlins and supported by the plurality of straps spanning between the plurality of purlins;

a plurality of sheet retention devices;

said seamless sheet is retained against opposing sides of the vertical portion of the purlin with two retention devices, wherein insulation is inserted between adjacent purlins of the plurality of purlins.

11. The seamless sheet for attachment to a plurality of purlins of a building of claim 10 wherein:

said seamless sheet and said plurality of straps having sufficient strength to withstand the force dropping of a 400 lb. weight from a height of 42 inches.

12. The seamless sheet for attachment to a plurality of purlins of a building of claim 10 wherein:

said plurality of sheet retention devices are removed after the insulation is installed.

13. The seamless sheet for attachment to a plurality of purlins of a building of claim 10 wherein:

at least one of said plurality of sheet retention devices includes at least one magnetic section.

14. The seamless sheet for attachment to a plurality of purlins of a building of claim 10, further comprising:

said seamless sheet is retained on a tube.

15. The seamless sheet for attachment to a plurality of purlins of a building of claim 14 wherein:

a rotating retention device is inserted to each end of the tube; and said rotating retention device includes a tube plug and a rotating handle, said rotating handle is rotatably retained relative to said tube plug.

16. A seamless sheet for attachment to a plurality of purlins of the building of claim 10, further comprising:

said seamless sheet having a first layer, a plurality of transverse strips spaced along a length thereof and a second layer, said transverse strips are retained between said first and second layers.

17. The building of claim 10, further comprising:

a release backing tape includes a first adhesive cover, an adhesive member, a second adhesive cover and a pull cord, said first and second adhesive covers are attached to opposing sides of the adhesive member, an end of said pull cord is secured to an end of said second adhesive cover, a length of said pull cord is lightly tacked to said length of said second adhesive cover.

18. A method of installing a seamless sheet on a plurality of purlins of a building comprising the steps of:

attaching a plurality of support straps spanning between adjacent purlins of the plurality of purlins;

providing a plurality of sheet retention devices;

securing an end of said seamless sheet to a first purlin of the plurality of purlins, retaining at least one of said plurality of sheet retention devices against one of said plurality of support straps;

wrapping said seamless sheet over a top of a second purlin of the plurality of purlins with excess seamless sheet material between the two adjacent purlins of the plurality of purlins to be in contact with the support straps, anchoring said seamless sheet adjacent to a side of the first purlin with one of said plurality of sheet retention devices, anchoring said seamless sheet adjacent to a side of the second purlin with a second one of said plurality of sheet retention devices; and retaining said seamless sheet in contact with the plurality of straps between successive purlins of the plurality of purlins, said seamless sheet is retained against the sides of successive purlins of the plurality of purlins with said plurality of sheet retention devices.

19. The method of installing a seamless sheet on a plurality of purlins of a building of claim 18, further comprising the step of:

inserting insulation between adjacent purlins of the plurality of purlins.

20. The method of installing a seamless sheet on a plurality of purlins of claim 18, further comprising the step of:

removing said plurality of sheet retention devices prior to installing roof sheeting.

21. The method of installing a seamless sheet on a plurality of purlins of a building of claim 18, further comprising the step of:

providing at least one of said plurality of sheet retention devices with at least one magnetic section.

22. The method of installing a seamless sheet on a plurality of purlins of a building of claim 18, further comprising the step of:

providing said seamless sheet with the strength to withstand dropping a 400 lb. weight from a height of 42 inches.

23. A method of installing a seamless sheet on a plurality of purlins of a building comprising the steps of:

attaching a plurality of support straps spanning between adjacent purlins of the plurality of purlins;

providing a plurality of sheet retention devices;

securing an end of said seamless sheet to a first purlin of the plurality of purlins;

wrapping said seamless sheet over a top of a second purlin of the plurality of purlins with excess seamless sheet material between the two adjacent purlins of the plurality of purlins to be in contact with the support straps, anchoring said seamless sheet adjacent to a side of the first purlin with one of said plurality of sheet retention devices, anchoring said seamless sheet adjacent to a side of the second purlin with a second one of said plurality of sheet retention devices;

retaining said seamless sheet in contact with the plurality of straps between successive purlins of the plurality of purlins, said seamless sheet is retained against the sides of successive purlins of the plurality of purlins with said plurality of sheet retention devices; and removing said plurality of sheet retention devices after installing insulation between said plurality of purlins.

24. A method of installing a seamless sheet on a plurality of purlins of a building comprising the steps of:

attaching a plurality of support straps spanning between adjacent purlins of the plurality of purlins;

providing a plurality of sheet retention devices;

securing an end of said seamless sheet to a first purlin of the plurality of purlins;

attaching one side of a release backing tape to opposing sides of the vertical portion of the purlin, said release back tape includes an adhesive cover, an adhesive member and a pull cord, an end of said pull cord is secured to an end of said adhesive cover;

wrapping said seamless sheet over a top of a second purlin of the plurality of purlins with excess seamless sheet material between the two adjacent purlins of the plurality of purlins to be in contact with the support straps, anchoring said seamless sheet adjacent to a vertical portion of the first purlin with one of said plurality of sheet retention devices, anchoring said seamless sheet adjacent to a vertical portion of the second purlin with a second one of said plurality of sheet retention devices, installing insulation between the two adjacent purlins and on top of the seamless sheet; and pulling said adhesive cover off said adhesive member, wherein said seamless sheet is secured to the adhesive member by force exerted by insulation placed between the two adjacent purlins.

* * * * *